United States Patent [19]

Graef et al.

[11] Patent Number: 4,462,587

[45] Date of Patent: Jul. 31, 1984

[54] METHOD OF AND SYSTEM FOR DETECTING BILL STATUS IN A PAPER MONEY DISPENSING

[75] Inventors: Harry T. Graef, Massillon; Mark J. Wise, North Canton, both of Ohio

[73] Assignee: Diebold Incorporated, Canton, Ohio

[21] Appl. No.: 309,022

[22] Filed: Oct. 5, 1981

Related U.S. Application Data

[63] Continuation-in-part of Ser. No. 305,847, Sep. 25, 1981, abandoned.

[51] Int. Cl.[3] ..... B65H 7/12

[52] U.S. Cl. ..... 271/263; 209/534; 209/603

[58] Field of Search ..... 271/263; 209/534, 603

[56] References Cited

U.S. PATENT DOCUMENTS

| | | | |
|---|---|---|---|
| 3,778,051 | 12/1973 | Allen et al. . | |
| 3,795,395 | 3/1974 | Ransom et al. . | |
| 3,826,487 | 7/1974 | Forster | 271/263 |
| 3,930,582 | 1/1976 | Gartner | 209/534 |
| 3,937,453 | 2/1976 | Hickey et al. . | |
| 4,066,969 | 1/1978 | Pearce et al. . | |
| 4,121,716 | 10/1978 | Luperti | 271/263 X |
| 4,154,437 | 5/1979 | Butcheck et al. . | |
| 4,159,782 | 7/1979 | Swartzendruber . | |
| 4,160,546 | 7/1979 | McMillan | 271/263 |
| 4,243,216 | 5/1979 | Mazumder . | |
| 4,243,983 | 1/1981 | Vyas . | |

FOREIGN PATENT DOCUMENTS

| | | |
|---|---|---|
| 2410998 | 9/1975 | Fed. Rep. of Germany . |
| 2030747 | 4/1980 | United Kingdom . |

*Primary Examiner*—Richard A. Schacher
*Attorney, Agent, or Firm*—Frease & Bishop

[57] ABSTRACT

Overlapped or folded bills in a paper money dispenser are detected by sensors that measure bill length and thickness. The sensors generate a first signal when bill thickness corresponds to the thickness of at least one standard bill and generate a second signal when bill thickness corresponds to at least twice standard bill thickness. A third signal is generated when bill thickness corresponds to at least three times standard bill thickness. The first and second signals, together with a fourth signal corresponding to the bill length, are supplied to a computer that identifies single or double bills as well as overlapped or folded bills and jammed bills. Bill count is incremented in response to identification of single or dispensable double bills. Overlapped bills, folded bills, double bills that cannot be dispensed, triple bills or suspicious bills are diverted to a storage canister.

13 Claims, 20 Drawing Figures

A) RESET THE SINGLE, DOUBLE AND TRIPLE COUNTS

B) TIME TO SAMPLE THICKNESS SENSOR? WAIT FOR 3.5 MS

C) SINGLE DETECT SIGNAL RECEIVED?

D) GET SINGLE COUNT FROM MEMORY AND INCREMENT

E) DOUBLE DETECT SIGNAL RECEIVED?

F) GET DOUBLE COUNT FROM MEMORY AND INCREMENT

G) TRIPLE DETECT SIGNAL RECEIVED?

H) GET TRIPLE COUNT FROM MEMORY AND INCREMENT

I) FEED CYCLE FINISHED?

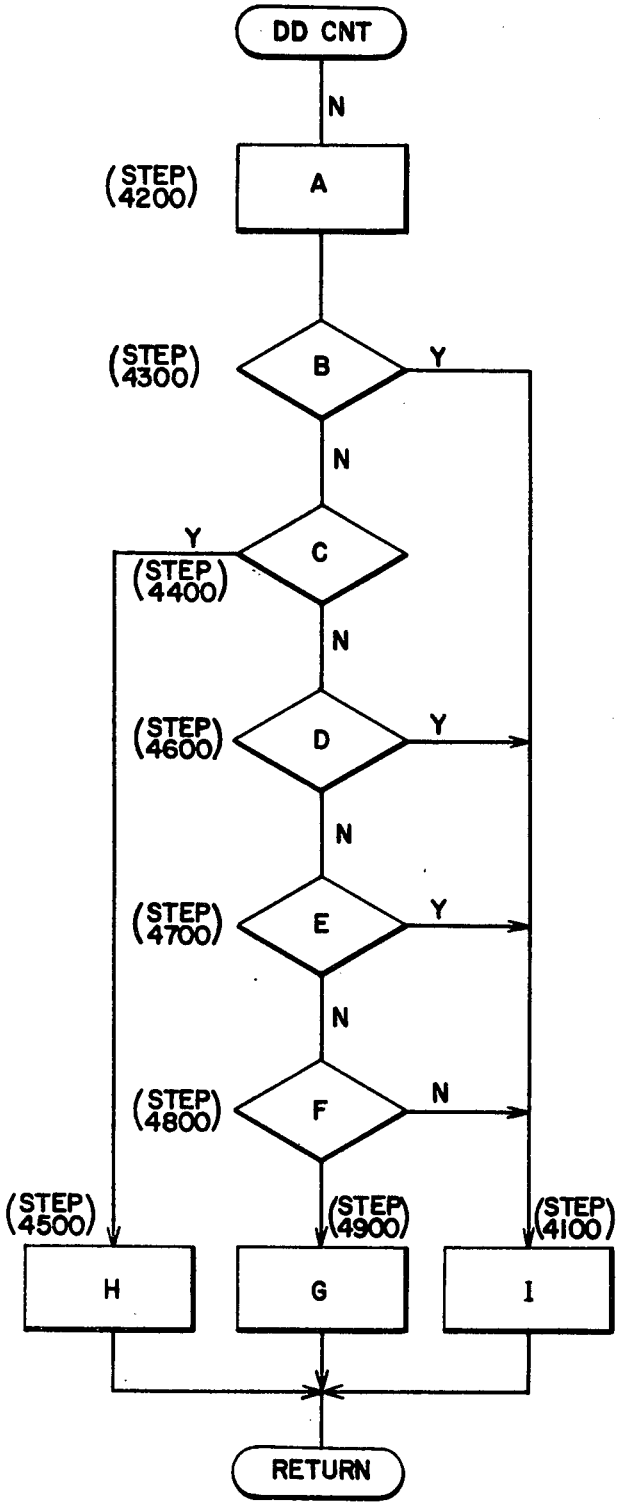

A) ADD THE SINGLE COUNT AND DOUBLE COUNT. (S+D)

B) IS THERE < ONE BILL?
(S+D)<PREDETERMINED SINGLE COUNT

C) IS THERE EXACTLY ONE BILL?
(S+D) = PREDETERMINED SINGLE COUNT

D) IS THERE > ONE BILL BUT < TWO BILLS?
(S+D) > PREDETERMINED SINGLE COUNT AND (S+D)<2 X PREDETERMINED SINGLE COUNT

E) ARE THERE EXACTLY TWO BILLS?
(S+D)=2 X PREDETERMINED SINGLE COUNT

F) CAN TWO BILLS BE DISPENSED?

G) INCREMENT THE BILL COUNT BY 2

H) INCREMENT THE BILL COUNT BY 1

I) STOP THE FEED MECHANISM, ACTIVATE THE DIVERT MECHANISM AND DIVERT THE UNDESIRED BILLS.

FIG. 7

METHOD OF AND SYSTEM FOR DETECTING BILL STATUS IN A PAPER MONEY DISPENSING

CROSS-REFERENCE TO RELATED APPLICATION

This application is a continuation-in-part of application Ser. No. 305,847, filed on Sept. 25, 1981, now abandoned.

CROSS-REFERENCE TO RELATED PATENT

The method and system of the invention comprise improvements on those disclosed in U.S. Pat. No. 4,154,437 dated May 15, 1979.

BACKGROUND OF THE INVENTION

1. Technical Field

The invention relates generally to sensing and identifying abnormalities in sheets being conveyed between storage and dispensing stations, and, more particularly, to automatic banking equipment wherein each bill in a paper money dispenser is monitored to identify single bills, multiple bills, overlapped bills, or folded bills as well as jammed bills, and the information is processed to control bill dispensing and accounting.

2. Background Art

A number of different systems have been used in the past for detecting conditions of sheets, such as paper money, currency bills, documents, etc. being conveyed, one by one, along a path of travel between source and delivery stations. In automatic banking equipment, for example, bills are transported along a conveyor from a source to an automatic teller station for dispensing. The bills must be counted along the line of travel so that the proper number of each bill denomination is ultimately dispensed to the customer.

During normal operation, the bills to be dispensed are spaced apart from each other along the conveyor. The presence of each bill at some point along the conveyor is monitored by any of several different types of detectors, such as thickness detectors that respond to the thickness of each bill, photoelectric sensors that respond to optical characteristics of the bill, conductance or capacitance sensors that respond to electrical characteristics and ultrasonic or pneumatic sensors that respond to bulk properties of the bill. Typically, such bill detecting apparatus have been incorporated into larger systems that respond to sensor generated data to identify single bills or double bills passing a detection point. Single, non-overlapped bills passing the detection point are counted to control dispensing such that the proper number of bills is dispensed to the customer and the appropriate account updated by the withdrawal amount. Double bills are counted as two bills and dispensed to the customer; if the double occurs during dispensing of the last bill, however, the bills are diverted and not counted. Bills that are folded or overlapped are diverted as suspicious bills since the equipment cannot identify with certainty the nature of the defect in normal bill flow. If the folded bill could be identified as a single bill rather than as, e.g., a torn bill, and if overlapped bills that might include folded-back portions could be identified as two bills, dispensing and accounting of these bills could be made. Bills identified as triple bills should be diverted and not dispensed. To optimize bill dispensing in automatic banking equipment, therefore, it is necessary to identify not only the presence of an abnormality in bill flow within a cash dispenser system but also to determine the particular type of abnormality so that proper action can be undertaken, i.e., dispense and account for the suspicious bills or divert the bills to storage.

One object of the invention, therefore, is to provide an improved method of and apparatus for detecting and identifying sheet spacing in a sheet conveying apparatus.

Another object is to provide a method of and apparatus for detecting and identifying bill flow in automatic banking equipment.

Another object is to provide a method of and apparatus for detecting and identifying overlapped or folded bills as well as single, properly spaced bills or double bills on a transport conveyor in an automatic cash dispenser.

Another object is to provide a method of and system for identifying single bills, double bills, triple bills and overlapped or folded bills as well as jammed bills in an automatic paper money dispenser.

Another object is to provide a method of and system for identifying single bills, double bills, triple or higher multiple bills and overlapped or folded bills as well as jammed bills in an automatic paper money dispenser, dispensing those bills considered dispensable according to predetermined criteria and diverting the remainder.

DISCLOSURE OF INVENTION

A method of and system for detecting and identifying folded or overlapped bills in a cash dispenser and distinguishing such bills from single bills and double bills on a conveyor, which includes a detector that measures the thickness and length of each bill or bills passing a detection point on a conveyor. The detector generates an electrical signal having a magnitude that is a linear function of bill thickness. The thickness signal is processed in a comparison circuit which develops a first output signal when bill thickness corresponds to the thickness of at least one standard bill and generates a second output signal when bill thickness corresponds to at least twice standard bill thickness. A third electrical signal developed by the detector and processed by circuitry identifies bill length corresponding to each thickness measurement, i.e., what percentage of the standard bill length corresponds to at least single bill thickness and what percentage corresponds to at least double bill thickness. A fourth electrical signal is developed by the detector when bill thickness corresponds to at least triple standard bill thickness. The first three electrical signals are applied to a microcomputer that performs an analysis to determine whether the bill being measured is a single bill, double bills, a folded bill or overlapped bills or whether there is some other abnormality in the bill transport sequence, e.g., jammed or late bill. If the bill is dispensable, i.e., if it is a single bill, a folded (single) bill or a doubles that is not the last bill to be dispensed, the bill is directed to the customer station for dispensing. If the bill cannot be identified as being in one of these catagories, e.g., is a torn bill or one that is otherwise suspicious, or is a non-dispensable double (last bill to be dispensed), or is a triples, the bill is diverted to a storage container.

Still other objects and advantages of the present invention will become readily apparent to those skilled in this art from the following detailed description, wherein we have shown and described only the preferred embodiments of the invention, simply by way of illustration of the best mode contemplated by us of carrying out our invention. As will be realized, the invention is capable of other and different embodiments, and its several details are capable of modification in various, obvious respects, all without departing from the invention. Accordingly, the drawings and description are to be regarded as illustrative in nature, and not as restrictive.

BRIEF DESCRIPTION OF THE DRAWINGS

FIG. 7 is a flow diagram of a routine for determining bill count based on the results of the bill quality determinations;

BEST MODE FOR CARRYING OUT THE INVENTION

Overview

The invention involves dispensing of documents, and in particular, dispensing currency bills in automatic banking equipment such as the type disclosed in Butcheck et al. U.S. Pat. No. 4,154,437, assigned to the assignee of the present invention and incorporated herein by reference in its entirety. The bills are conveyed by conveyors including a moving belt conveyor between a source of bills, such as a pair of lockable currency canisters, each holding a number of higher and lower denomination bills, and a customer delivery station. The canisters are positioned side by side and are each lockable, side loading units capable of holding on the order of 3,650 mixed old and new bills. Preferably, two canisters containing respectively one and ten dollar bills or possibly five and twenty dollar bills, for example, are provided. In practice, however, any number of canisters containing bills of different denominations can be provided.

During a currency dispense cycle, bills are picked, selectively, one by one, from the high and low denomination currency canisters by a picker mechanism, such as referred to in said U.S. Pat. No. 4,154,437, supra. The picker mechanism preferably includes a vacuum picker cup that picks each bill from the appropriate canister and moves the bill into a pair of output rollers that feed the bill into a pair of thickness gauging rollers where the status of the bill is determined, e.g., whether each point along the length of the bill is a single or a double bill thickness or possibly a larger multiple bill thickness. Thickness responsive signals generated by the gauging rolls are first processed in signal processing circuitry that conditions the detector signals and then analyzes signal magnitude to identify single bill, double bill or higher multiple bill thickness and then supplies the signal to a computer containing firmware that, depending upon preprogrammed criteria, either transfers the bill to the dispensing station or diverts the bill to a divert canister. As each bill is supplied to the dispensing station, a counter in the memory of the computer is incremented and when the bill count is equal to the requested number of bills, the dispensing cycle is terminated.

Bill Detector System

Figure 1:
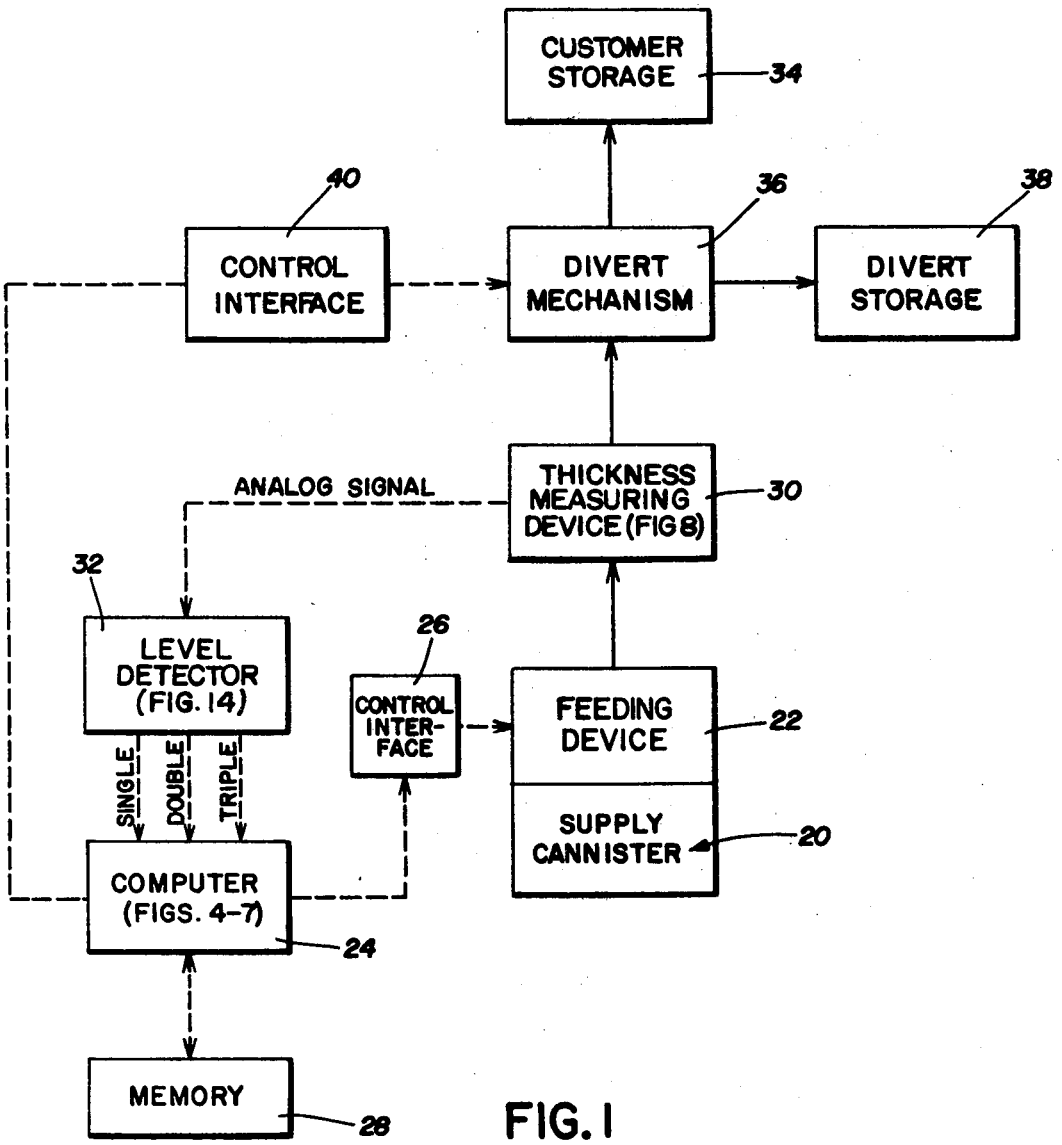
FIG. 1 is a block diagram illustrating automatic bill dispensing equipment using the bill status detector of the present invention.

With reference now to FIG. 1, bills to be dispensed are stored in a number of currency canisters of the type discussed above, identified generally by the numeral 20, containing respectively the high and low denomination bills. The bills stored in the currency canisters 20 are withdrawn, one by one, by a feeding device 22 that may be a conventional picker mechanism, as in U.S. Pat. No. 4,154,437, controlled by a computer 24 via interface 26.

Computer 24 is preferably a conventional microprocessor, such as a standard type 8080 microprocessor, programmed by firmware stored in memory 28.

Bills withdrawn from supply 20 are applied to a thickness measuring device 30 constituting bill thickness gauging rolls and associated thickness detectors to be described in detail below. The thickness measuring device 30 generates an analog signal as a function of bill thickness for a time duration corresponding to the length of the bill, i.e., the amount of time that the travelling bill is within the gauging rolls. Level detector 32 in turn generates signals to be applied to computer 24 indicating whether each point along the length of the bill under test is a single bill thickness, a double bill thickness or a triple (or higher order multiple) bill thickness, and firmware within the computer analyzes that information to determine whether the entire bill is a single bill, a double bill (doubles), a triple bill (triples) or is a single or multiple bill that has folded-back portions or portions overlapped with another bill or, alternatively, is jammed or delayed on the conveyor. Depending upon the status of the bill, and where the bill occurs in the bill count, i.e., whether it is the last bill to be dispensed, the bill is either dispensed to the customer at storage unit 34 or diverted by a mechanism 36 to a divert canister 38. The divert mechanism 36 is controlled by the computer 24 through a control interface circuit 40, to be described in detail below.

In FIG. 1, the supply 20, feeding device 22, divert mechanism 36, customer storage 34 and divert storage canister 38 are all known in the prior art and are described in U.S. Pat. No. 4,154,437. Programming for computer 24 stored in memory 28 in the form of firmware, however, as well as the control interface 26, 40, level detector 32 and thickness measuring device 30 shall also be described in detail below.

Basic Operation

Figure 2:
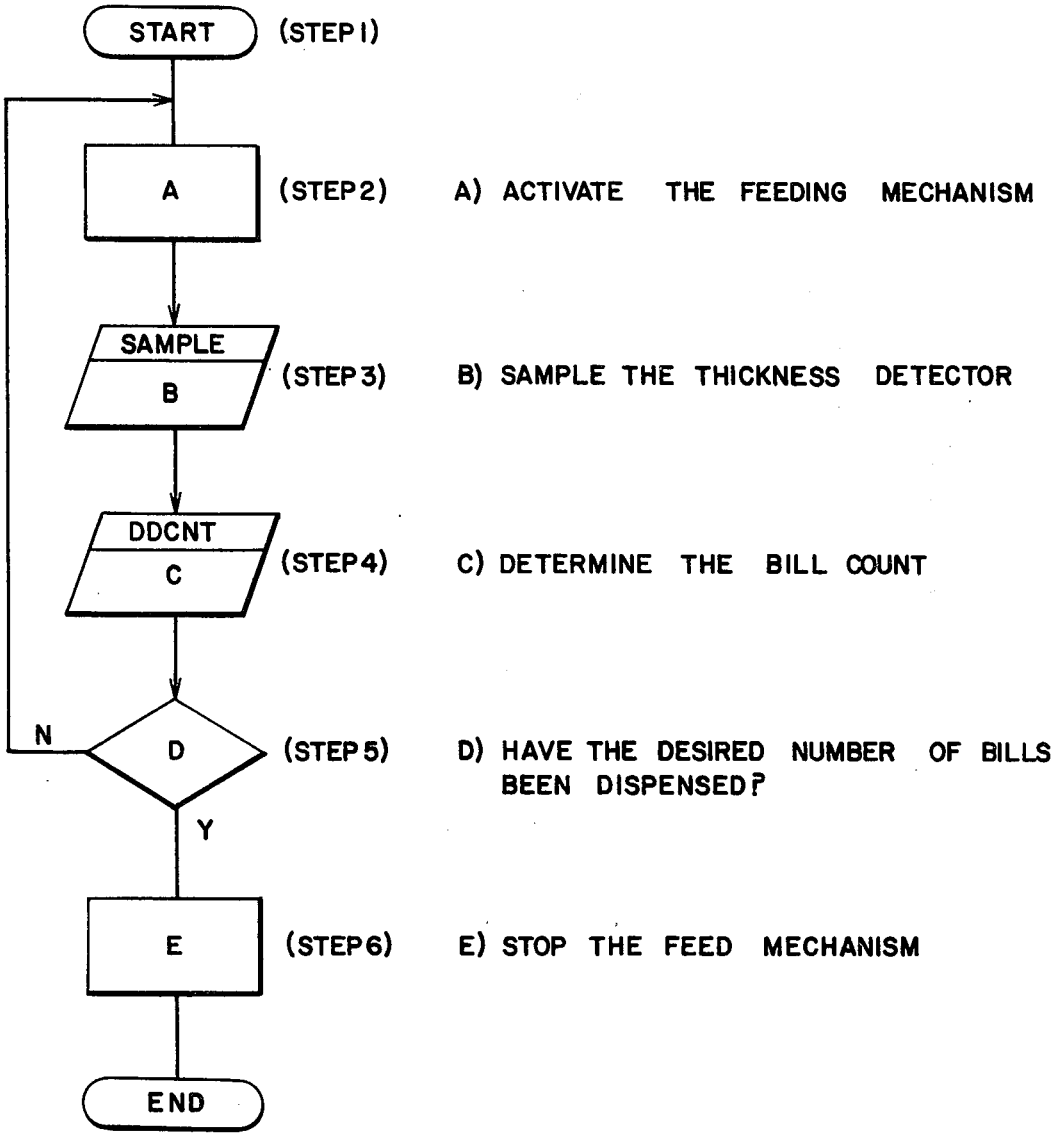
FIG. 2 is a system flow chart describing the general operation of the equipment shown in FIG. 1.

The operation of the system of FIG. 1 is shown generally in the basic system flow chart of FIG. 2. Firmware stored in memory 28 controls the computer 24 following a start command (step 1) at the beginning of an operating cycle to generate signals that activate feeding device 22 (step 2) to withdraw currency bills from supply stack or canisters 20 in accordance with withdraw authorization. In step 3, the thickness measuring device 30 is directed by computer 24 under control of firmware in memory 28 to sample the thickness of each bill passing, one by one, through the thickness gauging rolls. Bill count, as determined from step 4, based upon thickness measurement and time measurement criteria set forth in detail below, is stored in memory 28. The bill count stored in memory 28 is compared with the authorization bill count in step 5. When the desired number of bills have been dispensed, the feed mechanism 22 is stopped (step 6).

Bill Thickness Measurement; General

In accordance with an important aspect of the present invention, the status of each bill is determined by sampling bill thickness along the entire length of the bill. Each thickness sample is analyzed to determine whether it corresponds to at least single standard bill thickness, at least double standard bill thickness or at least triple standard bill thickness. By counting the number of samples along the length of the bill corresponding to at least single bill thickness and at least double bill (doubles) thickness, respectively, and comparing those counts to predetermined count criteria, determinations of bill status, such as single bill, double bill, folded bill, overlapped bills, etc. can be made. The triple bill thickness measurement identifies triples.

The analysis for identifying single and double bills is explained more clearly with reference to FIGS. 3*a*–3*f*. In each case, the percent of the total length of the bill having single bill thickness S is measured. The percent of the length having double bill thickness D is also measured. The two quantities are added and the result analyzed to identify bill status. If S+D=100%, the bill is considered to be a single; and if S+D=200%, it is considered a double; otherwise the bill is considered suspicious.

Figure 3A:
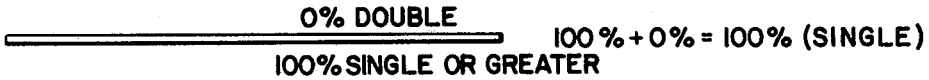
FIGS. 3*a*–3*f* are illustrations of various bill conditions that are detected and identified by the systems, methods or apparatus of the invention.

Thus, in FIG. 3*a*, a single bill will cause only single bill thickness pulses S to be generated over 100% of the bill length. No double bill thickness pulses are generated since the bill has a uniform, single bill thickness throughout. Thus, S+D=100%+0%=100% and the bill is identified as a single.

Figure 3B:
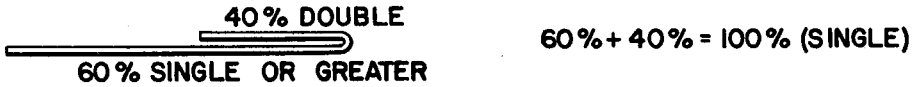

In FIG. 3*b*, there is a 40% foldback on a single bill. Thus, bearing in mind that bill thickness is at least that of a single standard bill over 60% of the length, a single thickness signal S is generated along 60% of the bill length and a double signal D is generated along the remaining 40%. Since S+D is equal to 60% plus 40%, or 100%, the bill is again determined to be a single bill.

Figure 3C:
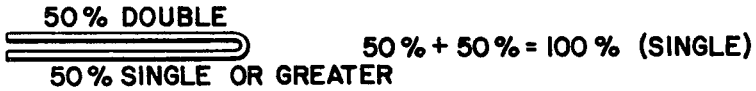

In FIG. 3*c*, there is a total foldback of a single bill. Thus, the single bill thickness signal S is generated along 50% of the bill length and the doubles signal D is generated along 50% of the length of the bill (the bill has an "at least single bill" thickness along 50% of the bill length and an "at least twice single bill" thickness along the same 50% bill length). Since S+D is equal to 50% plus 50%, or 100%, the bill is once again identified as a single bill.

Figure 3D:
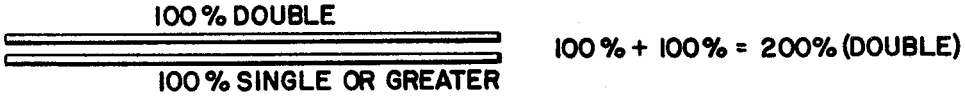

In FIG. 3*d*, a double bill, or "doubles", causes the single bill thickness signal to be generated along 100% bill length and the double bill thickness signal D to be generated along 100% of the bill length. Since S+D is equal to 100% plus 100%, or 200%, the bill is identified as a doubles.

Figure 3E:
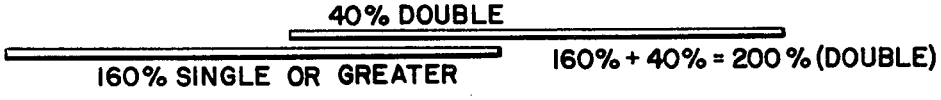
Figure 3F:
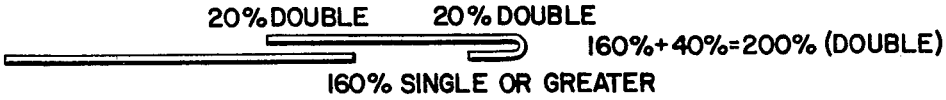

In FIG. 3*e*, there is a 40% overlap between two bills. Thus, the single bill thickness signal S is generated along a total of 160% of standard bill length and the double bill thickness signal D is generated along 40% (the length of overlap). Since the sum of the two signals, S+D, is equal to 200%, the bill is identified as a doubles.

In FIG: 3*f*, there is a 20% overlap between two bills and a 20% foldover of one of the bills. The single bill thickness signal S is thus generated along a total of 160% of standard bill length and the double bill thickness signal D is generated along 40%. The bill is identified as a doubles since the sum of the two signals, S+D, is 200% standard bill length.

In other words, if the sum of the two signals S+D corresponds to 100% bill length, the bill is identified as a single bill; if the sum corresponds to 200% of bill length, the bill is identified as a doubles. If the sum S+D does not equal 100% or 200% of standard bill length, the bill is identified as a suspicious bill.

Bills passing through thickness measuring device 30, to be described in detail below, undergo thickness measurement along the entire length of each bill. Each point along the length of the bill that is measured (bill thickness in practice is measured once each 3.5 milliseconds) and classified to be, at that point, a single bill, a doubles or a higher bill multiple (e.g., triple). Analysis of the thickness measurements are made by computer 24 under control of firmware in memory 28, and an accounting is maintained in the memory.

Figure 4:
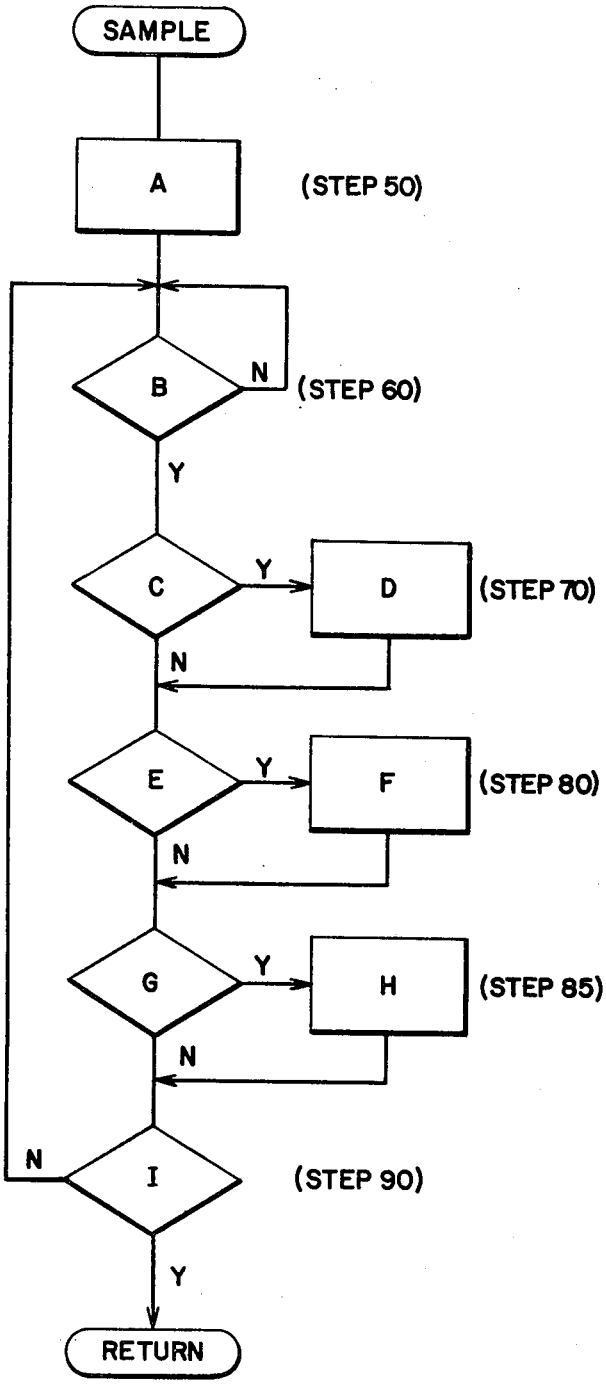
FIG. 4 is a flow diagram of a bill thickness sampling subroutine employed in use of the invention.

Referring to FIG. 4, the subroutine for sampling bill thickness is illustrated in flow chart form. It is understood, however, that the particular subroutine illustrated is only exemplary. It is also to be understood that each step of the subroutine is standard and would be known to microprocessor programmers of ordinary skill. Further, the subroutine of FIG. 4 assumes that triple bill thicknesses as well as singles and doubles are monitored. In practice, the subroutine may be limited to singles and doubles or may be expanded to higher order multiples.

In step 50, all counts stored in memory, viz, the single count, double count and triple count, are reset to zero at the beginning of a thickness measurement associated with an incoming bill or bill cluster. Step 60 controls bill thickness sampling in synchronism with a 3.5 millisecond clock so that samples are time spaced by 3.5 milliseconds. In step 70, if a single detect signal, i.e., a signal indicating that single bill thickness at the 3.5 millisecond detection point is being measured, the single bill thickness count in memory is incremented. Similarly, with respect to steps 80 and 85, double and triple counts, respectively, are incremented at corresponding memory locations. Steps 60–85 are repeated during a bill measurement cycle so that, at the end of the measurement cycle, as determined in step 90, three counts identifying, respectively, single, double and triple thickness portions of the measured bill are obtained. The singles and doubles portions are analyzed in subsequent subroutines according to the criteria described in connection with FIGS. 3*a*–3*f* above, to determine bill quality, e.g., torn bill, etc., bill status, i.e., single, double, etc., and whether the bill is dispensable as well as to control counters for proper accounting. An accounting of triples is maintained independently of the above criteria since any triples, identified as a bill having a predetermined number of triple thickness samples, is diverted and not dispensed. Triples can, however, be detected and accounted for to be dispensed to the customer, if desired, using the criteria of FIGS. 3*a*–3*f*.

Bill Quality Determination

Figure 5:
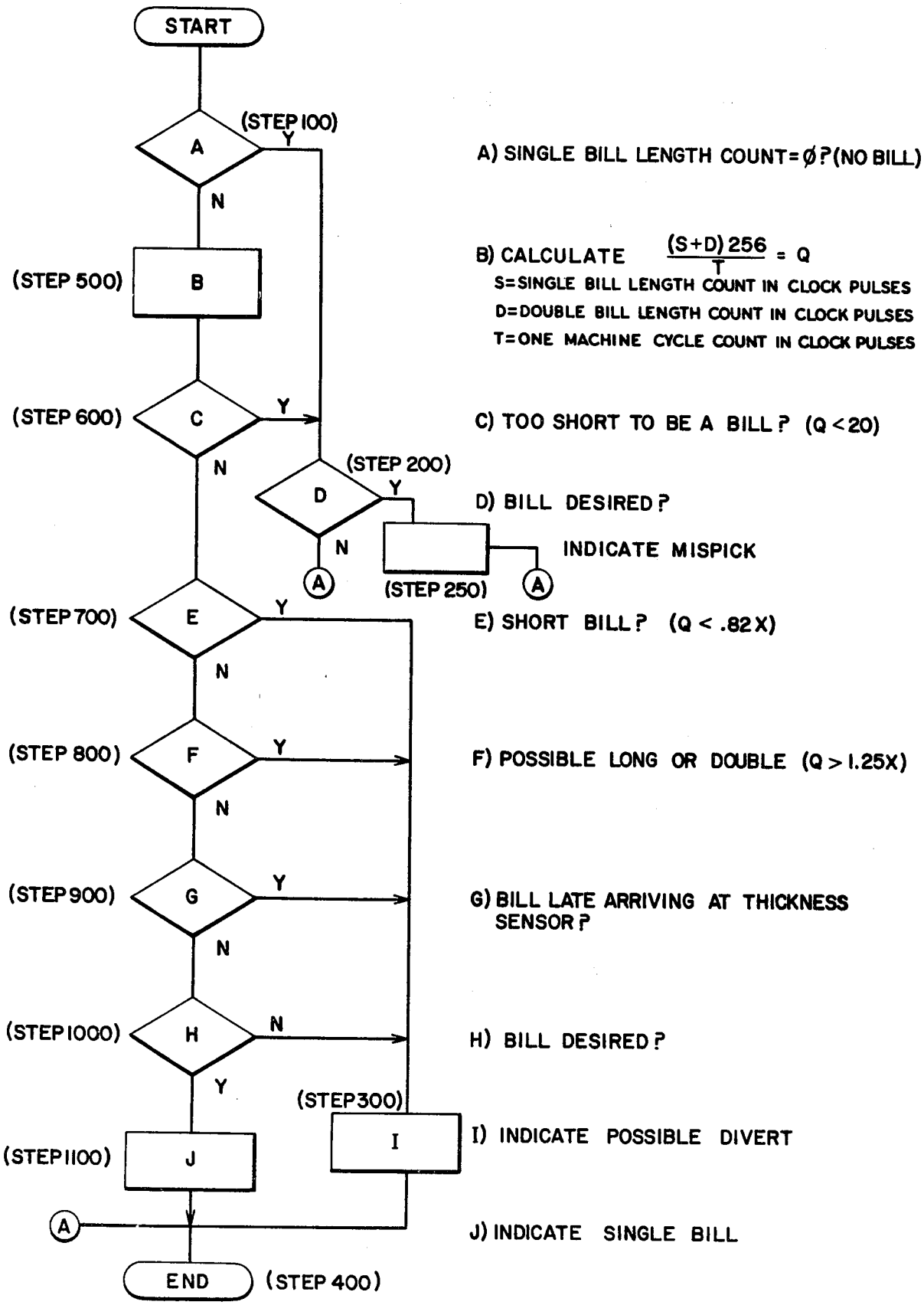
FIG. 5 is a flow diagram of a subroutine for determining bill quality from the thickness and length measurements obtained in use of the invention.
Figure 6:
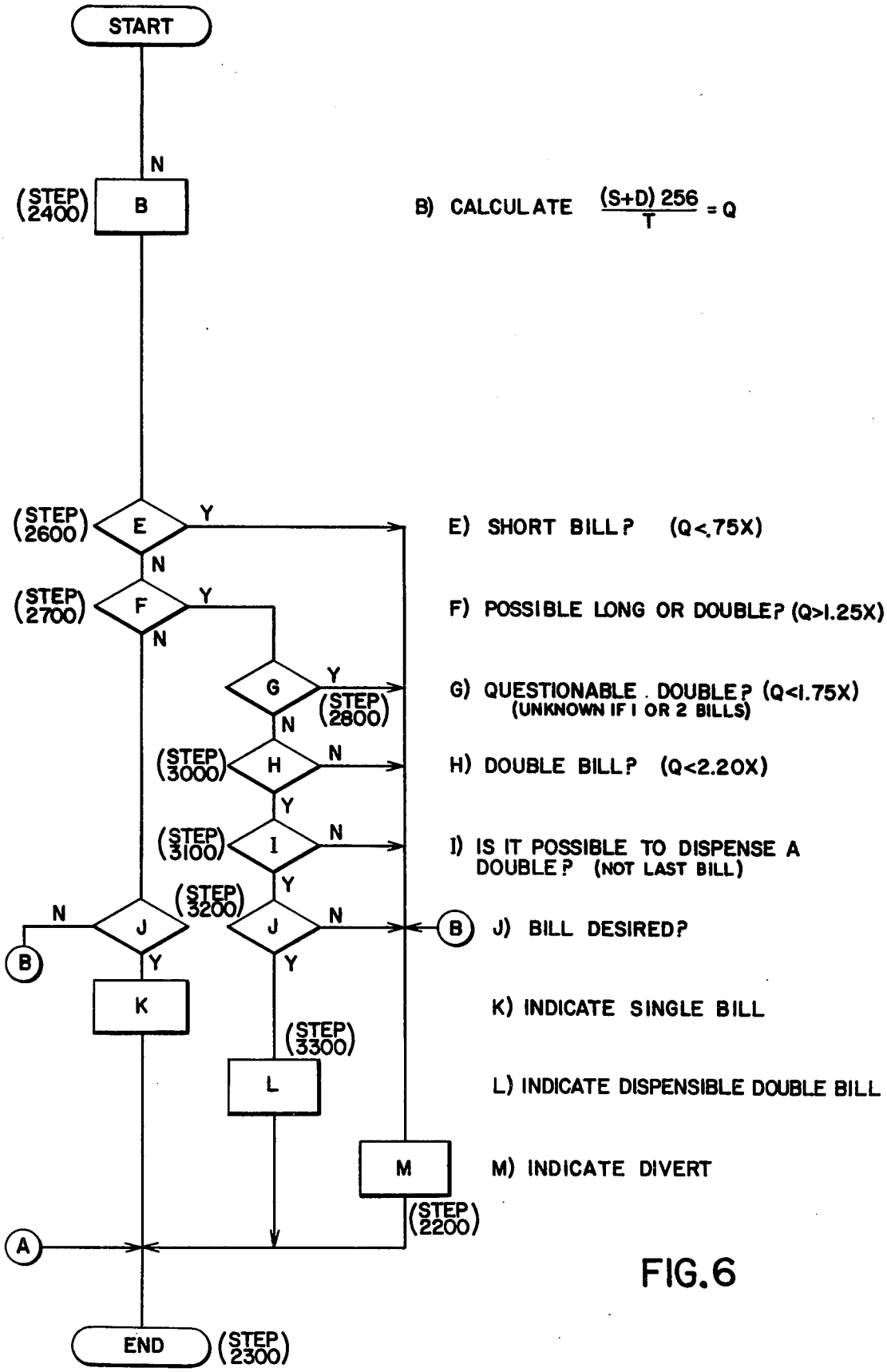
FIG. 6 is a flow diagram of a second subroutine for making a more detailed bill quality determination than was made in the first quality determination of FIG. 5.

Each time a bill is picked from storage 20 to be dispensed, a quality determination of the bill is made in accordance with the routines shown in the flow diagrams of FIGS. 5 and 6. Briefly, a first bill quality determination subroutine performs a series of calculations which determine general bill quality. These bill status determinations are (1) no bill, (2) too short to be a bill, (3) short bill, (4) possible long or double bill or (5) good bill. If the test routine determines undesirable bill quality, a possible divert cycle is initiated. If the bill satisfies all criteria for a good bill, however, the subroutine of FIG. 5 indicates a single bill. The routine shown in the flow diagram of FIG. 6 for determining bill quality a second time performs a second series of calculations similar to the first routine of FIG. 5 but with more comprehensive testing. The second routine performs bill length and thickness calculations with more comprehensive criteria and operates in five stages, viz, (1) bill picked, (2) short bill, (3) dispensable double, (4) indicate single bill and (5) indicate divert.

More specifically, in accordance with the first bill quality test routine of FIG. 5, in step 100, a determination is made whether a bill is actually picked by the bill pick mechanism, or feeding device 22 (FIG. 1). If the picker does not pick and deliver a bill to the detect rollers (that is, the single bill length count is equal to zero), it is presumed that there is no bill and picking continues. A mispick is indicated in step 250 assuming that a bill delivery is desired in accordance with step 200. If no bill delivery is required, however, the subroutine skips to the end of the subroutine at step 400.

Assuming, however, that a bill is detected in step 100, the subroutine advances to step 500 where bill length is measured and normalized with respect to the length of a machine cycle. The calculation consists of solution of the following equation:

$$Q = \frac{(S + D)256}{T}$$

where:

S=single bill thickness length count in clock pulses;

D=double bill thickness length count in clock pulses; and

T=number of clock pulses in one machine cycle.

In step 600, a determination is made whether, as a result of the calculation performed in step 500, the measured value is too short to be a valid bill. In practice, a value is considered to be too short to be a bill if the result of the calculation step 600 is less than 20.

If the result of the calculation is less than 20 it is assumed that no bill was picked and the counts were the result of noise signals associated with bill detection.

If the bill is not too short to be a bill but is nevertheless shorter than a normal bill, that is, when Q, calculated from step 500, is determined to be less than 0.82x, where x is a known good bill length to machine cycle ratio (step 700), a possible divert is indicated in accordance with step 300.

Similarly, in accordance with step 800, a determination is made based upon the calculation of step 500 that the measured bill is a possible long bill or a double bill. In practice, this determination is made if the resultant Q is greater than 1.25x, where, again, x is the known good bill length to machine cycle ratio.

In accordance with step 900, if the bill arrives late at the thickness measuring device 30, indicating a possible equipment malfunction, a possible divert is indicated.

In step 1000, a determination is made whether a bill delivery is desired. If no delivery is required, the routine indicates a possible divert in accordance with step 300; otherwise, step 1100 is initiated to indicate a good single bill, that is, to index the single bill data in memory to account for another bill.

The second bill quality determination is shown in the flow chart of FIG. 6. In step 2400 the bill length calculation corresponding to step 500 in FIG. 5 is made. In step 2600 a bill that is less than the length of the normal bill is diverted. In this case, the bill is diverted if the length is less than three-fourths the length of a standard bill. A good single is indicated if the measured length is greater than 0.75 times and less than 1.25 times the nominal length of the standard bill.

In step 2700, a possible long or double bill is identified in a manner similar to step 800 in FIG. 5. If the bill is considered to be a possible long or doubles, determinations are made that the bill is a questionable double (step 2800), or that the bill is a double bill (step 3000). In practice, the bill is considered to be a questionable doubles if the measured length in accordance with step 2400 is greater than 1.25 times and is less than 1.75 times the nominal length of a standard bill. The bill is considered to be a good doubles if the measured length is greater than 1.75 times and less than 2.2 times the nominal length of the standard bill (step 3000).

In accordance with step 3100, a determination is made whether it is possible to dispense a doubles. It is possible to dispense a doubles, and to increment the memory by two bill counts, so long as the doubles does not include the last bill to be dispensed. Otherwise, a customer will receive an extra bill. If it is not possible to dispense the doubles, the routine indexes to step 2200 for a possible divert.

Next, a determination is made, in step 3200, whether dispensing of a bill is desired, in other words, whether bill dispensing is called for by the customer and the number of bills previously dispensed is less than the number requested. Assuming that a bill is not desired, the routine indexes to step 2200 so that any detected bill is diverted to the divert canister; otherwise, the routine indexes to step 3300 indicating a doubles to be dispensed.

With reference to FIG. 7, the document count routine makes a determination of whether a bill is a single bill or a doubles and, if a doubles, whether the doubles can be dispensed. If the bill is a single bill, the bill count stored in memory is incremented by one. If the bill is a dispensable double bill, the bill count is incremented by two. Otherwise, the divert mechanism is operated to divert the bill. This routine uses the principles described above with respect to FIGS. 3a–3f.

In step 4200, the single count and doubles count are added together to obtain a summation count S+D. The single count pulses are generated in response to at least one bill passing through the measuring device 30 and the double count pulses are generated when at least two bills pass through the device.

In accordance with step 4300, the sum is analyzed to determine whether the sum S+D is less than 100% bill length; in other words, whether the length of the bill having at least single bill thickness together with the length having at least double bill thickness is less than full bill length. If so, the bill is diverted, in accordance with step 4100, as a suspicious bill.

In step 4400, the sum S+D, is analyzed. If there is exactly one bill, as determined by the sum S+D in accordance with the criteria described above in connection with FIGS. 3a–3f, the routine jumps to step 4500 where the document count stored in memory is incremented by one.

In step 4600, the sum S+D is analyzed to determine whether it falls within a bill count sum corresponding to greater than one bill but fewer than two bills. If so, the bill is diverted in accordance with step 4100. Similarly, step 4700 analyzes the sum to determine whether there are exactly two bills, that is, whether S+D equals twice the single bill count.

If there are exactly two bills, as determined in step 4700, a determination is made, in step 4800, whether the two bills can be dispensed. If the two bills, constituting the doubles, do not include the last bill to be dispensed, the bills are dispensable, and the bill count in memory is incremented by two (step 4900).

Thickness Measurement; Apparatus

Figure 8A:
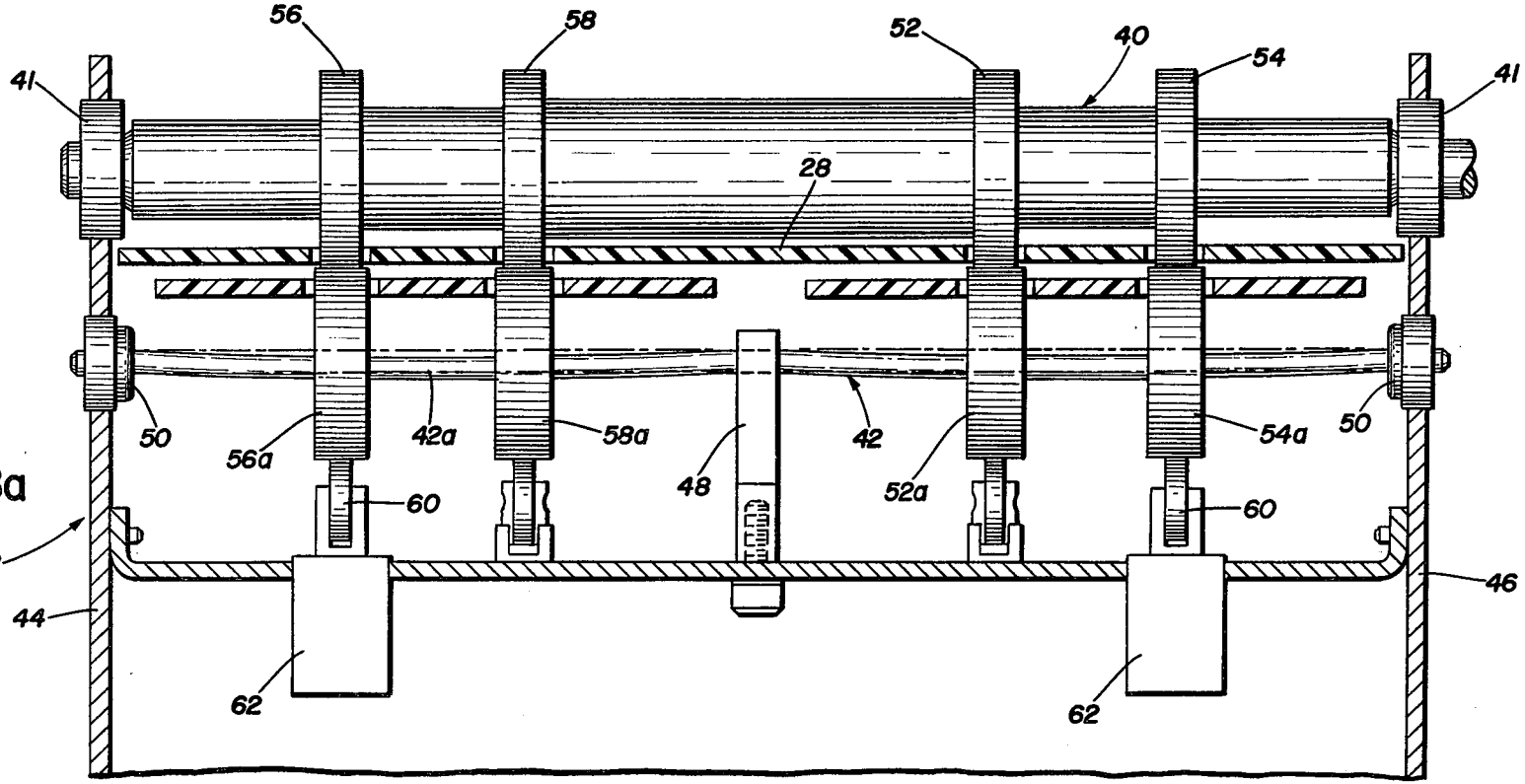
FIG. 8*a* is a plan sectional view taken through the gauging roll axes of the bill thickness sensors illustrating the gauging rolls awaiting passage of bills between the rolls.
Figure 8B:
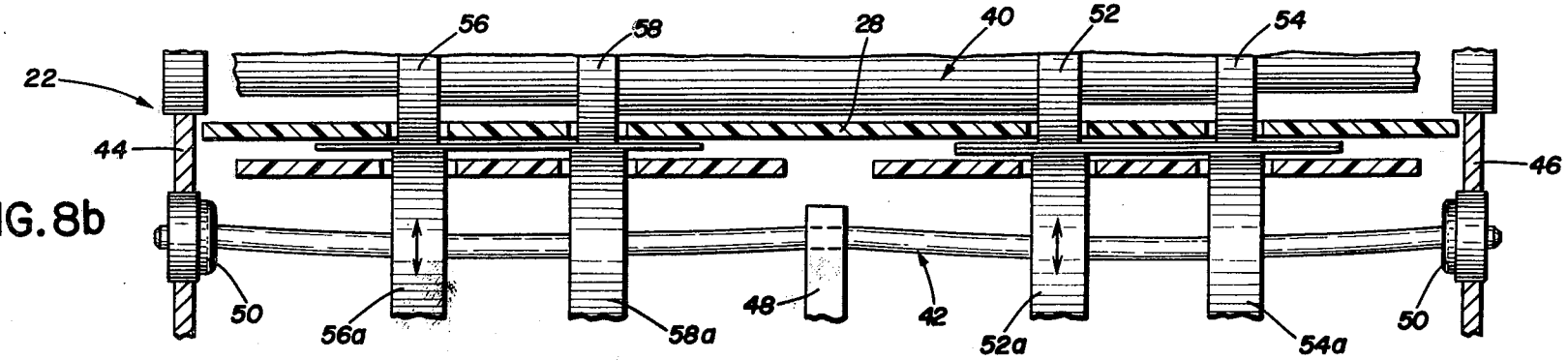
FIG. 8*b* is a fragmentary view similar to that of FIG. 8*a* illustrating a single bill passing between one set of gauging rolls, and a doubles condition of two bills passing between another set of gauging rolls.

Referring now to FIGS. 8a and 8b, the thickness measuring device, generally identified by the numeral 30 in FIG. 1, comprises a large diameter, rigid shaft 40 and a small diameter, flexible shaft 42, both mounted on side walls 44 and 46 of the housing of picker 22. The shaft 40 has a large diameter cross-section to prevent bowing under loading and is mounted on bearings 41 whereas the shaft 42 has a small diameter cross-section to permit shaft bowing flexibility. The shaft 42 is supported midway its ends by a support 48, and is non-rotatably mounted on the side walls 44 and 46 at end supports 50.

The shaft 40 carries a pair of spaced rolls 52 and 54 near side wall 46 and another pair of spaced rolls 56 and 58 near the opposite side wall 44.

Mounted on antifriction bearings on the flexible shaft 42 are rolls 54a, 52a, 58a and 56a at positions corresponding to the portions of rolls 54, 52, 58 and 56 respectively on shaft 40. The rolls 54a and 52a and the corresponding rolls 54 and 52 are normally in rolling contact with each other. Similarly, rolls 58a and 56a and corresponding rolls 58 and 56 are normally in rolling contact with each other. Rolls 52, 52a, 54 and 54a are dedicated to bills stored in one supply canister whereas rolls 56, 56a, 58 and 58a are dedicated to bills in a second storage canister. These rolls are referred to as "gauging rolls" since they serve to gauge bill thickness. The bills stored in the two storage canisters are, respectively, high denomination bills and low denomination bills, such as one dollar bills and five dollar bills or possibly five dollar bills and twenty dollar bills, as mentioned above, or any other combination.

Considering only rolls 56, 56a, 58 and 58a for simplicity, assuming that no bills are located between the roll pairs, as shown in FIG. 8a, flexible shaft portion 42a assumes a slight downward bow as shown in full lines. The phantom lines in FIG. 8a illustrate the appearance of the shaft portion 42a if the shaft were straight and not bowed.

In the left hand portion of FIG. 8b, a single bill is passing between rolls 56, 56a and between rolls 58 and 58a. Similarly, in the right hand portion of FIG. 8b, a doubles is passing between rolls 52 and 52a and between rolls 54 and 54a. The rolls 56a and 58a on flexible shaft 42 deflect downwardly, as shown in FIG. 8b, by an amount corresponding to the thickness of a single bill, whereas the rolls 52a and 54a on shaft portion 42 deflect downwardly by a distance corresponding to doubles thickness since there is a doubles passing between the rolls.

With reference to FIG. 8a, the lower end of each of the rolls 56a and 54a is in contact with rolls 60 journalled on the upper end of thickness sensors or detectors 62, each generating a voltage that is linearly related to deflection applied to the corresponding contact roll 60. The sensors 62 are preferably electronic devices, such as the Electro-Mike manufactured by Electro Corporation of Sarasota, Fla., which generate a voltage that varies very precisely as a function of small amounts of input deflection, i.e., the order of bill thickness (several milli-inches). This analog voltage is processed in electric circuitry shown in FIGS. 9–14, to obtain digital signals identifying, respectively, singles and doubles passing in contact with sensor 62.

Signal Processing Circuitry

Referring to FIGS. 9–14, circuitry is shown in accordance with the invention for responding to the analog thickness dependent signals generated by sensor 62 at each of the two shaft portions 42a, 42b (FIGS. 8a and 8b) that feed, respectively, high and low denomination bills. It is to be understood that the circuitry shown is dedicated to each supply canister in the equipment. In practice, the circuitry is duplicated to provide operation with a second canister. Only one circuit is described herein for brevity.

Figure 9:
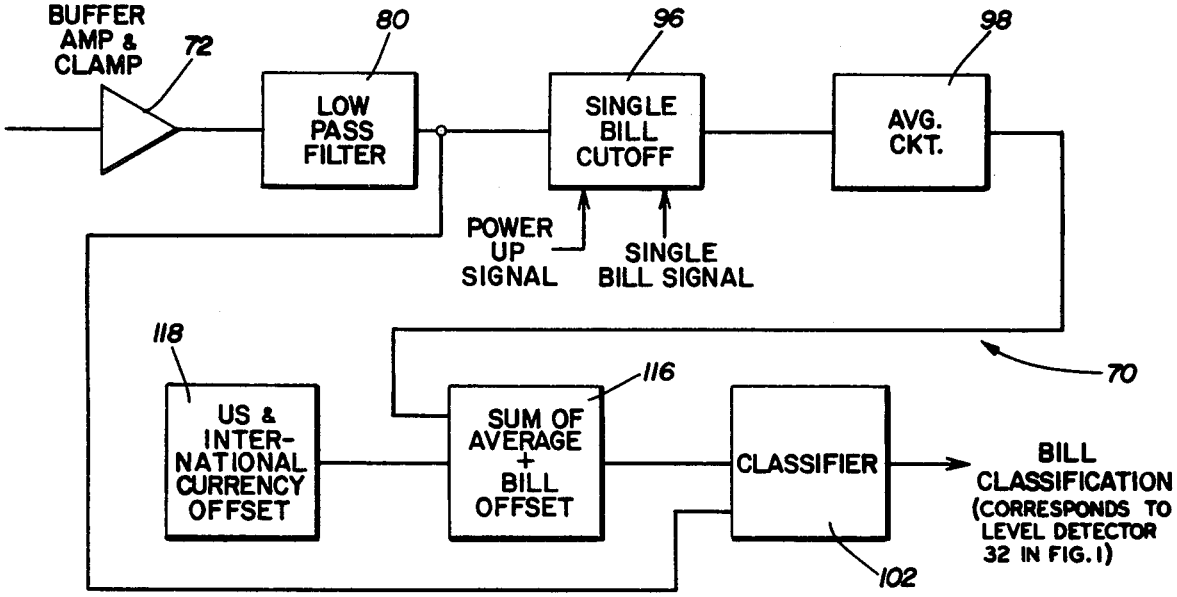
FIG. 9 is a block diagram of circuitry for generating a bill classification signal in response to the thickness measurements.
Figure 10:
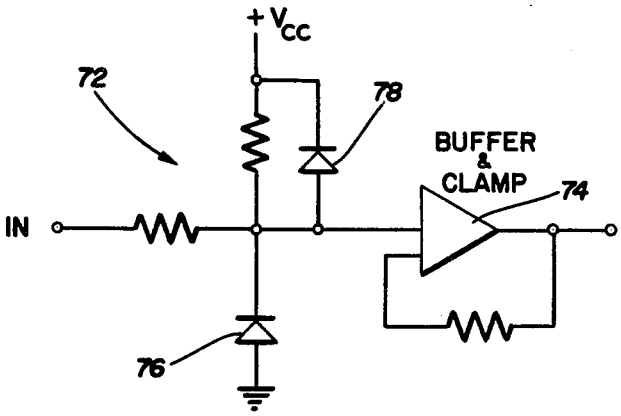
FIG. 10 is a detailed circuit diagram of the buffer amplifier and clamp shown in FIG. 9.
Figure 11:
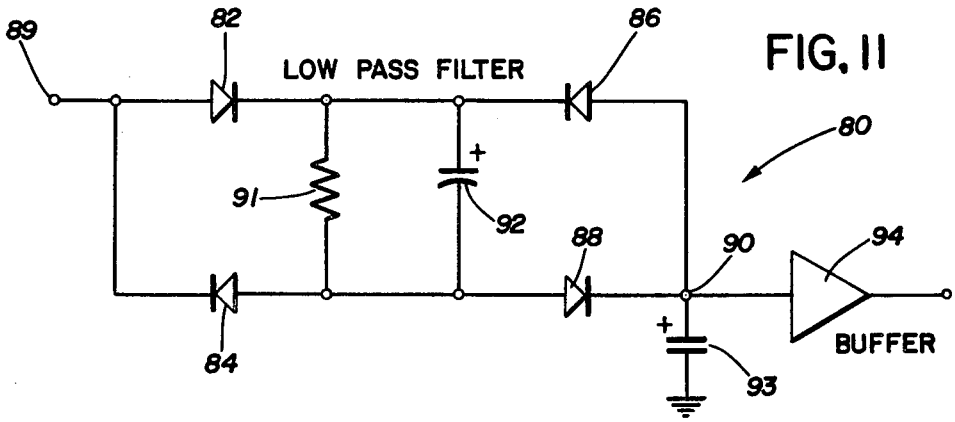
FIG. 11 is a circuit diagram illustrating details of the low pass filter shown in FIG. 9.

Considering first the block diagram of FIG. 9 that illustrates the basic components of the circuitry designated generally by the numeral 70, a buffer amplifier and clamp stage 72 is connected to be responsive to the output of sensor 62 to generate a voltage having a magnitude corresponding to the magnitude of the sensor output voltage. The input impedence of buffer amplifier 72 is extremely high to prevent loading of the sensor 62. Clamping circuitry within the stage 72 clamps the output voltage of sensor 62 to be limited between the supply voltage, $V_{cc}$, and ground. The buffer amplifier and clamping stage 72, shown in detail in FIG. 10, comprise a conventional operational amplifier 74 connected in a standard negative feedback configuration and including, in its input network, diodes 76 and 78. The diode 76 is connected between the inverting input of amplifier 74 and ground with the polarity indicated to clamp negative voltage to ground.

Diode 78 is connected between the inverting input of the amplifier 74 and the supply voltage $V_{cc}$ to clamp to the supply voltage input voltages larger in magnitude than $V_{cc}$. The amplifier 74 is preferably connected as a unity gain stage, with the output voltage undergoing a polarity reversal. If the sensor 62 is disconnected from the input of buffer amplifier and clamp stage, the input of the stage 72 is clamped by diode 78 to the positive supply voltage $V_{cc}$.

The output of the buffer amplifier and clamp circuit 72 is applied to low pass filter 80 which passes bill thickness information but attenuates bearing runout noise. The low pass filter 80, shown in detail in FIG. 11, comprises an array of diodes 82, 84, 86 and 88 connected in a series-parallel circuit between input terminal 89 and terminal 90. A capacitor 92 and a resistor 91 are connected between the cathodes of diodes 82, 86 and between the anodes of diodes 84, 88. Another capacitor 93 is connected between terminal 90 and ground, and a buffer amplifier 94 is connected at the output of the filter 80 at terminal 90. The buffer amplifier 94 is preferably a voltage follower circuit that electrically isolates capacitor 93 from the output circuit of the filter 80.

The output of low pass filter 80 is applied to a single bill cutoff circuit 96 that is responsive to bills passing between the gauging rolls 56, 56*a* and 58, 58*a* to block signals generated by the thickness sensor 62 in the absence of a bill. The purpose of cutoff 96 is to electrically isolate noise signals generated by the sensor 62 caused by vibrations in the gauging rolls 56, 56*a* and 58, 58*a* that occur in the absence of a bill. The cutoff circuit is necessary to prevent averaging of bearing noise occurring in the absence of a bill from being applied to averaging circuit 98, discussed below. Thus, no signals in the absence of a bill, which in practice would be related to the bearing runout noise, are able to pass through 96. To enable the sensor signal to pass through the gate 96 at power up, i.e., when the system is initially turned on, however, a power up signal generated from conventional power up responsive circuitry (not shown) is applied to the cutoff 96 which enables the cutoff to pass sensor signals to averaging circuit 98.

The averaging circuit 98 averages the output voltage of sensor 62 to establish a reference for bill classification. The sensor voltage passing through cutoff gate 96 is averaged and the resultant voltage is monitored to establish a reference voltage for subsequent bill classification.

Figure 12:
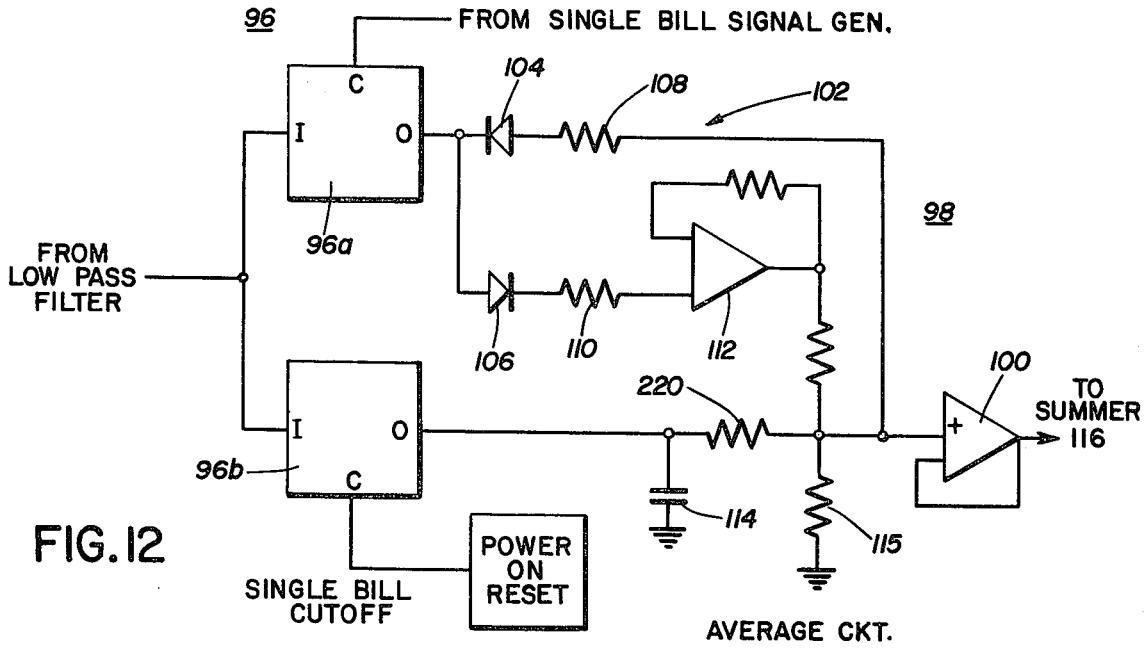
FIG. 12 is a circuit diagram showing details of the single bill cutoff and averaging circuit shown in FIG. 9.
Figure 13:
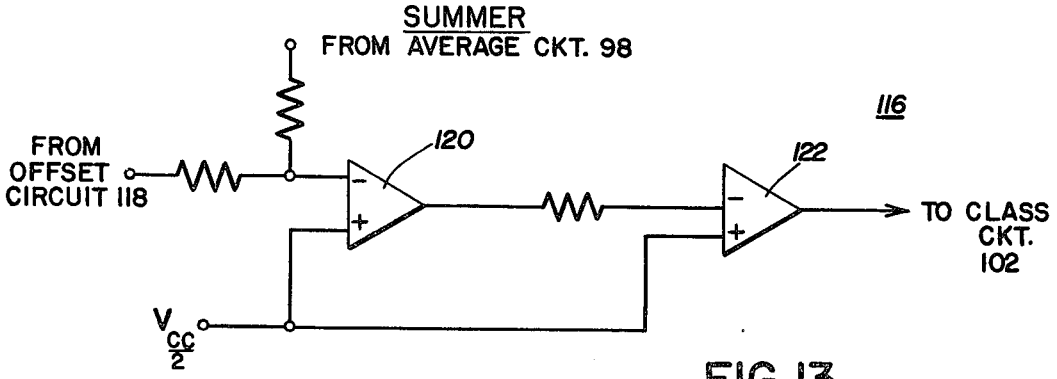
FIG. 13 is a circuit diagram of the summer and offset circuit shown in FIG. 9.

Details of the averaging circuit together with the single bill cutoff circuit are shown in FIG. 12. The single bill cutoff circuit 96 comprises a pair of controlled switches 96*a* and 96*b* having inputs connected to receive signals from the output of low pass filter 80 and outputs coupled to a buffer amplifier 100. The switch 96*a* is controlled to turn on in response to the output of a classifier circuit 102 to be described below, indicating the presence of a single bill and passes the filter signal through to buffer amplifier 100 only when at least a single bill is detected as being between the gauging rolls 56, 56*a* and 58, 58*a*. The output of the switch 96 is coupled to the amplifier 100 through coupling network 102 that comprises a pair of diodes 104, 106 and resistors 108, 110. The diode 104 and resistor 108 are connected in series directly to the input of amplifier 100, and the diode is poled to pass only negative sensor voltage to the amplifier. The diode 106 is poled so as to apply positive sensor voltage to the buffer amplifier 100 through resistor 110 and inverting amplifier 112. The sensor voltage that passes through the gate 96*b* is averaged by resistors 115 and 220 and capacitor 114. This voltage level, monitored by buffer 100, establishes a voltage for classification reference. When bill classification is determined, the gate 96*a* is turned off to isolate the output of the sensor from the averaging circuit 98.

The effective value of capacitance 114 is multiplied by a substantial factor, such as 2000, by amplifier 112. The capacitor 114, together with the resistor 115 and associated components, attains a time constant by capacitance multiplication that is high enough to maintain the reference voltage at an approximately constant level before the bill enters the gauging rolls and high enough to maintain the voltage on the averaging capacitor 114 during bill jamming of short duration.

The output of averaging circuit 98 is applied to a summer circuit 116 (see FIG. 13) that sums the output of the average circuit 98 with an offset signal developed by a circuit 118 to distinguish between United States and foreign currency. The offset circuit 118, not shown in detail, comprises a number of resistance voltage dividers and switches that selectively supply different offset voltages obtained from the dividers to summer circuit 116 depending upon the kind of currency being dispensed.

The summer circuit 116 (see FIG. 13) comprises a first summing amplifier 120 having an inverting input connected to receive signals generated respectively from the averaging circuit 98 and the offset circuit 118. The non-inverting input of summer amplifier 120 is connected to a reference ($V_{cc}/2$). The output of the first summing amplifier 120 is connected to the inverting input of a second amplifier 122 that also has a non-inverting input connected to the reference $V_{cc}/2$.

Figure 14:
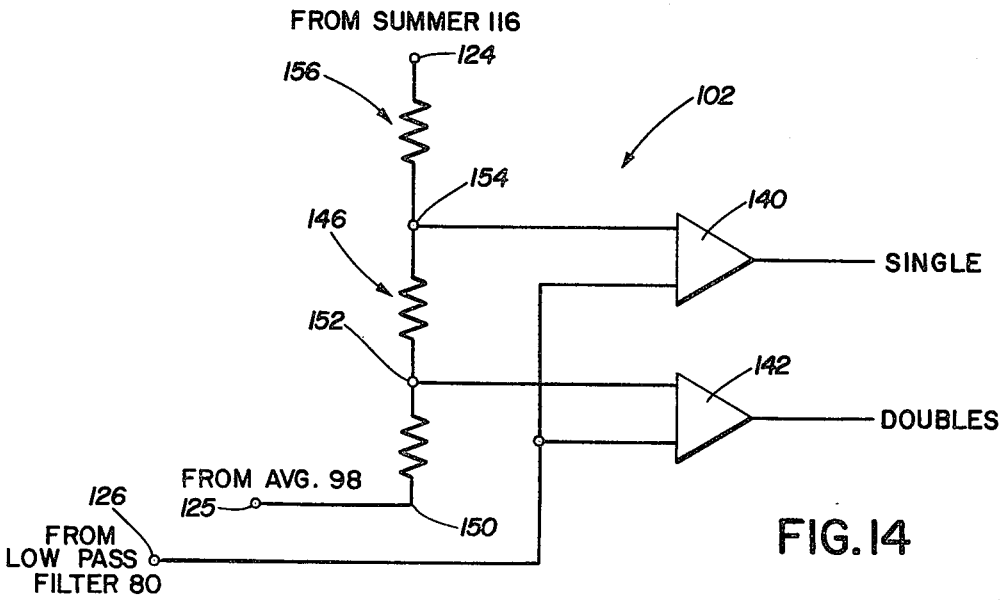
FIG. 14 is a circuit diagram of the classifier circuit shown in FIG. 9.

Referring again to FIG. 9, the output of summer circuit 116 is applied to one input of classifier circuit 102; the second input of classifier 102 receives an output signal from low pass filter 80. The purpose of the classifier circuit 102, shown in detail in FIG. 14, is to establish a voltage based upon average sensor voltage to classify bills. Thus, the average bill voltage, corrected by the offset, is supplied to one reference input 124 of the classifier 102 whereas the instantaneous sensor voltage obtained from the output of low pass filter 80 is applied to opposite reference input terminal 125 of the circuit 102. Since the average sensor voltage is applied to terminal 125 and the average sensor voltage minus the currency offset voltage is applied to the opposite reference input terminal 124, a fixed DC voltage equal to the offset voltage is established by common mode rejection across reference resistor divider network 156 of the classification circuit 102. Thus, any variation in sensor voltage cancels out and does not affect the classification reference voltage.

The test signal input terminal 126 of classifier circuit 102 is connected to the output of low pass filter 80 which, as aforementioned, generates a voltage that is a function of the instantaneous thickness of bills passing between the gauging rolls 56, 56*a* and 58, 58*a*. The sensor signal is compared by comparators 140, 142 with two reference voltages derived from the classification reference voltage divider network 146. The reference voltages of the two comparators are obtained from nodes 154, 152 of the resistance voltage divider 146 between summer and averaging circuit input terminals 124 and 125. Thus, comparator 140 compares the sensor voltage with the singles trip voltage developed at first reference terminal 154. Comparator 142 generates a signal when the sensor voltage corresponds to the doubles trip voltage at reference node 152. The reference voltages at nodes 152 and 154 are established by the values of the various series resistors on resistor string 156. The two signals generated by classification circuit 102 are applied to computer 24 for analysis, as described above, and the output of the single bill comparator 140 is also applied to control switch 96*a* of FIG. 12, as also described above.

The classifier circuit 102 of FIG. 14 is illustrated in the form of a two level classifier (singles and doubles) for simplicity. Triples are detected using a similar circuitry having a third level of signal detection, i.e., an additional divider resistor and comparator in a standard manner.

In this disclosure, there is shown and described only the preferred embodiments of the invention, but as aforementioned, it is to be understood that the invention is capable of use in various other combinations and environments and is capable of changes or modifications within the scope of the inventive concept as expressed herein. For example, although the invention has been described using digital signal processing, it is to be understood that the same principles can be applied using analog signal processing without departing from the spirit of the invention.

We claim:

1. A method of detecting sheet status, such as overlapped sheets or folded sheets, on a sheet delivery conveyor, comprising the steps of measuring sheet thickness along the entire length of the sheet, and in response, generating a first signal when the measured sheet thickness corresponds to the thickness of at least one sheet and a second signal when the measured thickness corresponds to the thickness of at least two sheets; measuring sheet length and, in response, generating a third signal; arithmetically summing durations of said first and second signals related to corresponding sheet lengths and, in response, generating a fourth signal; and interpreting said third and fourth signals to determine sheet status.

2. A method of identifying particular abnormalities, such as overlapped sheets or folded sheets on a sheet delivery conveyor, comprising the steps of measuring sheet thickness along the entire length of the sheet, measuring sheet length, generating a plurality of first signals as a function of different sheet thicknesses, generating a second signal as a function of the measured sheet length, arithmetically summing time durations of the plurality of first signals to obtain a third signal, and interpreting said second and third signals to identify sheet abnormality type.

3. A method of identifying bill status in an automatic paper money dispenser, comprising the steps of measuring bill thickness along the entire length of the bill to obtain a first electrical signal, measuring bill length to obtain a second electrical signal, processing said first and second electrical signals to obtain third electrical signals representing bill lengths having respectively, different multiple bill thicknesses; arithmetically summing time durations of the third signals to obtain a fourth electrical signal; comparing said fourth signal with a corresponding reference electrical signal; and, in response, identifying bill status such as overlapped or folded bills, single bills, double bills or jammed bills.

4. In a money dispenser including a conveyor for transporting bills from a money supply source to a delivery station, an apparatus for identifying overlapped bills or folded bills on said conveyor, comprising:

means for measuring bill thickness, along an entire length of said bill;

means responsive to said thickness measuring means for generating a first signal when bill thickness corresponds to the thickness of at least one bill and for generating a second signal when bill thickness corresponds to the thickness of at least two bills;

means responsive to the thickness measuring means for developing a third electrical signal proportional to the duration of the first signal and developing a fourth signal proportional to the duration of the second signal;

means for arithmetically summing said third and fourth signals to develop a fifth signal; and means responsive to said fifth signal for identifying identifying overlapped or folded bills on said conveyor.

5. In an automatic paper money dispenser, a method of identifying bill status such as single bill, double bills, overlapped bills and folded bills, comprising the steps of measuring bill thickness along the entire length of the bill;

generating a first electrical signal when the measured bill thickness corresponds to the thickness of at least on standard bill;

generating a second electrical signal when the measured bill thickness corresponds to at least twice the thickness of one standard bill;

arithmetically summing the durations of said first and second electrical signals to obtain a third electrical signal;

comparing said third electrical signal with corresponding reference signals; and generating a fourth electrical signal in response to the comparing step for identifying bill status.

6. In an automatic paper money dispenser, wherein bills are transferred on a conveyor means between a supply source and a customer station for delivery, a system for identifying bill status prior to delivery, comprising:

means for measuring bill thickness along the entire length of each bill;

means for generating a first electrical signal when the measured bill thickness corresponds to the thickness of at least one standard bill;

means for generating a second electrical signal when the measured bill thickness corresponds to at least twice the thickness of a standard bill;

means for arithmetically summing the durations of said first and second electrical signals to obtain a third electrical signal identifying bill portions having at least single standard bill thickness and bill portions having at least double standard bill thickness;

means for comparing said third electrical signal with a corresponding reference signal; and means responsive to said comparing means for generating a fourth electrical signal identifying bill status.

7. In an automatic paper money dispenser, a method of identifying bill status such as single bill, double bills, triple bills, overlapped bills and folded bills, comprising the steps of:

measuring bill thickness along the entire length of the bill;

generating a first electrical signal when the measured bill thickness corresponds to the thickness of at least one standard bill;

generating a second electrical signal when the measured bill thickness corresponds to at least twice the thickness of one standard bill;

generating a third electrical signal when the measured bill thickness corresponds to the thickness of at least three times the thickness of one standard bill;

arithmetically summing the durations of said first, second and third electrical signals to obtain a fourth electrical signal identifying a summation of bill portions having at least single standard bill thickness, bill portions having at least double standard bill thickness, and bill portions having at least triple standard bill thickness;

comparing said fourth electrical signal with a corresponding reference signal; and generating a fifth electrical signal in response to the comparing step for identifying bill status.

8. A method of detecting sheet status such as folded or overlapped sheets on a conveyor carrying a series of said sheets, comprising the steps of measuring sheet thickness, generating a first signal when the measured sheet thickness corresponds to the thickness of at least one standard sheet, generating a second signal when the measured thickness corresponds to at least twice standard sheet thickness, measuring sheet length, generating a third electrical signal proportional to the arithmetic summation of said first and second signals as a function of sheet length, and interpreting said third signal to determine sheet status.

9. The method of claim 3, 5 or 7 including the step of dispensing double bills.

10. The method of claim 3, 5 or 7 including the steps of determining if a single bill is dispensable and dispensing said bill.

11. The method of claim 3, 5 or 7 including the steps of detecting non-dispensable single or double bills and diverting said non-dispensable bills.

12. The method of claim 3, 5 or 7 including the step of diverting a double bill if said double bill is a last bill to be dispensed.

13. The method of claim 12 including the additional step of dispensing a single bill rather than the double bill as the last bill.

* * * * *

UNITED STATES PATENT AND TRADEMARK OFFICE

CERTIFICATE OF CORRECTION

PATENT NO. : 4,462,587

DATED : July 31, 1984

INVENTOR(S) : Harry T. Graef et al

It is certified that error appears in the above-identified patent and that said Letters Patent is hereby corrected as shown below:

In the Title, the last word "DISPENSING should read

-- DISPENSER --

Signed and Sealed this

*Twelfth* Day of *March 1985*

[SEAL]

*Attest:*

DONALD J. QUIGG

*Attesting Officer* *Acting Commissioner of Patents and Trademarks*